United States Patent [19]

Kersbergen

[11] Patent Number: 4,639,054

[45] Date of Patent: Jan. 27, 1987

[54] CABLE TERMINAL CONNECTOR

[75] Inventor: Mark D. Kersbergen, Longmont, Colo.

[73] Assignee: Intelligent Storage Inc., Longmont, Colo.

[21] Appl. No.: 721,238

[22] Filed: Apr. 8, 1985

[51] Int. Cl.[4] ..... H01R 9/09; H01R 13/70

[52] U.S. Cl. ..... 339/14 R; 29/854; 200/292; 339/107; 339/147 R; 339/176 MF

[58] Field of Search ..... 339/14 R, 17 R, 17 L, 339/17 C, 17 F, 17 LC, 176 MF, 107, 147 R, 147 P; 361/399, 410; 200/292; 29/854

[56] References Cited

U.S. PATENT DOCUMENTS

| | | | |
|---|---|---|---|
| 3,371,250 | 2/1968 | Ross et al. | 361/419 |
| 3,434,095 | 3/1969 | De Rose | 339/17 R |
| 3,447,120 | 5/1969 | Rask et al. | 339/143 |
| 3,476,870 | 11/1969 | Ross | 174/69 |
| 3,479,565 | 11/1969 | Ross et al. | 174/68.5 |
| 3,495,025 | 2/1970 | Ross | 174/70 |
| 3,627,903 | 12/1971 | Plummer | 174/72 A |
| 3,639,716 | 2/1972 | Rasmussen | 339/17 F |
| 3,654,380 | 4/1972 | Tatum et al. | 174/47 |
| 3,838,317 | 9/1974 | Coyne | 339/18 C |
| 3,909,508 | 9/1975 | Ross | 174/117 M |
| 3,984,622 | 10/1976 | Ross | 174/72 A |
| 4,105,278 | 8/1978 | Braund et al. | 339/176 MF |
| 4,157,612 | 6/1979 | Rainal | 339/176 MF |
| 4,352,531 | 10/1982 | Gutter | 339/14 R |
| 4,415,216 | 11/1983 | Narozny | 339/107 |
| 4,448,474 | 5/1984 | Melnychenko | 339/176 MF |
| 4,451,099 | 5/1984 | Bricker, Jr. et al. | 339/176 MF |
| 4,498,716 | 2/1985 | Ward | 339/17 R |

OTHER PUBLICATIONS

Connector System for Transmission-Line Cables, Wilding, Eleventh Annual Connector Symposium Proceedings, pp. 308-316, 10-1978.

Berg SLT/MST Connector System, Berg Electronics, Du Pont Bulletin, 1260, 10-1983.

*Primary Examiner*—Neil Abrams

*Attorney, Agent, or Firm*—William W. Cochran, II

[57] ABSTRACT

A cable terminal which connects two woven ribbon cables and has a terminal connector which is capable of engaging standard device connectors. A switch mounted in the cable terminal provides selective interconnection of the woven ribbon cables in the cable terminal which allows the channel to be fed back when the cable terminal is unplugged. The cable terminal can be employed in a tag cable for computer applications. The cable terminal utilizes a housing which can be disassembled for repair of conductive connections within the cable terminal. The cable terminal employs a PC board which provides two-sided termination with a separate connector for each signal wire to reduce termination time. Additionally, mass ground terminators are also provided to reduce termination time. Teeth are incorporated within the structure of the housing to engage the woven ribbon cable so as to provide strain relief between the woven ribbon cable and the PC board. The cable terminal provides for in-line connection of the signal wires while allowing interconnection to other pins through the conductive paths provided on the PC board. This allows easy and quick connection of the signal wires to the PC board and interconnection with nonspatially aligned pins.

3 Claims, 13 Drawing Figures

CABLE TERMINAL CONNECTOR

BACKGROUND OF THE INVENTION

1. Field of the Invention

The present invention pertains generally to cable terminals and more specifically to a cable terminal which is capable of connection with a standardized device connector and selective interconnection of the cables.

2. Discussion of the Background of the Invention

In the computer industry, specialized tag cables are required for connecting communication cables from a CPU to a control unit and/or a peripheral device. Tag cables comprise tag-in and tag-out cables which are both connected to a single cable terminal. This single cable terminal may utilize plug connectors which allow the tag-in and tag-out cables to be conductively connected. Termination procedures in the cable terminator are tedious and time consuming because of the necessity to attach two separate cables. In many cases this requires the soldering of two wires to a single pin which is difficult and many times produces an improper connection. Consequently, a cable terminal is needed which allows quick and easy termination of two ribbon cables and is also capable of selectively interconnecting the two ribbon cables.

Examples of inventions relating to cable terminals and ribbon cables are disclosed in the following:

| U.S. Pat. No. | Inventor | Date |
|---|---|---|
| 3,371,250 | E. A. Ross et al. | Feb. 27, 1968 |
| 3,447,120 | S. Rask et al. | May 27, 1969 |
| 3,476,870 | E. A. Ross | Nov. 4, 1969 |
| 3,479,565 | E. A. Ross et al. | Nov. 18, 1969 |
| 3,495,025 | E. A. Ross | Feb. 10, 1970 |
| 3,627,903 | Plummer | Dec. 14, 1971 |
| 3,639,716 | Rasmussen | Feb. 1, 1972 |
| 3,654,380 | Tatum et al. | Apr. 4, 1972 |
| 3,909,508 | E. A. Ross | Sept. 30, 1975 |
| 3,984,622 | E. A. Ross | Oct. 5, 1976 |
| 4,352,531 | Gutter | Oct. 5, 1982 |
| 4,415,216 | Narozny | Nov. 15, 1983 |
| Berg Electronics | Wilding | Oct. 25, 1978 |
| Du Pont Bulletin | #1260 Berg SLT/MST Connector System | Oct., 1983 |

The Narozny patent discloses the use of a channel receiving U-shape bar 48 which receives ground wires, as illustrated in FIG. 5. Relief is provided to the ribbon cable by providing an arcuate bend in the cable which engages closing channels, as illustrated in FIG. 3.

The Gutter patent discloses a common ground elements which utilizes a helical spring, as illustrated in FIG. 3, which selectively engages ground wires 54. Signal wires 52 selectively engage appropriate contacts 20, 22. Stress relief is provided by a serpentine housing 44, as shown in FIG. 5.

The Rasmussen patent discloses a transfer switch located at the terminating end of the cable assembly. The transfer switch engages a printed circuit panel to provide selective activation of connection paths.

The disclosure by Wilding discusses the conventional use of a paddle board as an interface between a terminal connector and a cable. The Wilding design eliminates the use of a paddle board. Wilding uses a buss bar assembly in which all of the ground wires are bent backwards and soldered thereto, as illustrated in FIG. 5. A serrated surface, as illustrated in FIG. 1, provides strain relief.

The Du Pont bulletin discloses a cable terminal utilizing a paddle board and provides strain relief as disclosed on Page 9. The remaining patents pertain to woven ribbon cable construction.

As is apparent from these references, ribbon cables have been used for sometime to transmit data over a number of channels simultaneously. Cable terminals have been used in conjunction with ribbon cables to provide a conductive connection to standardized device connectors used on devices such as computers and peripheral devices in the computer industry. Standardized device connectors may be provided on various ports of computer terminals, CPUs, controller boxes, printers and other such devices in the computer field. Additionally, standardized device connectors are commonly used throughout the electronics, industry and especially in the communications industry. Hence, it is of importance to provide a cable terminal having a terminal connector which is compatible with standardized device connectors so that the cable terminal may be readily used to make conductive connections between various devices.

Numerous problems have existed in providing a cable terminal which provides easy and quick termination of the ribbon cable in a cable terminal device which provides strain relief between the ribbon cable and the various connections made within the cable terminal, and which allows disassembly of the cable terminal if conductive connections are broken or improperly made within the cable terminal. For example, strain relief has been provided in prior art cable terminals by the use of a potting material to fill the cable terminal voids and hold the ribbon cable securely within the cable terminal. The disadvantage with such devices is that the potting material prevents disassembly of the cable terminal so that the cable terminal cannot be repaired if a conductive connection is improperly made or becomes broken. Additionally, selection of the potting material must be made with great care since shrinkage during curing can cause conductive connections to break. The inability to disassemble and repair cable terminals results in a very high trash rate for cable terminals constructed in this manner.

Additionally, many cable terminals require soldering of signal and/or ground wires to specific pins of the terminal connector which is an expensive and time-consuming process. The systems may be restricted to a spatially oriented connection which limits the flexibility of connecting specific connectors to various pins of the terminal connector. Other systems allow connection of both signal and ground wires to any desired pin of the terminal connector. In these systems, however, mistakes can easily be made in the termination process resulting in signal and ground wires being connected to incorrect pins.

Insulation displacement cable terminals have been used to overcome problems associated with the time required in performing the termination process. These systems, however, are usually spatially aligned cable terminals which require a spatial in-line connection between the terminal connector and the conductors of the ribbon cable. Consequently, these systems do not provide the ability frequently required to connect various signal and ground wires to different pins on the terminal connector. These problems have been overcome to some extent by the use of printed circuit (PC)

boards which allow connection of the ribbon cable to any desired output pin on the terminal connector, while maintaining the in-line spatial position of the connecting points of the ribbon cable to the PC board. However, the disadvantages of quick termination are lost connectors since prior art PC board connectors have required a significant amount of time to make discreet terminations of both ground and signal wires.

SUMMARY OF THE INVENTION

The present invention overcomes the disadvantages and limitations of the prior art by providing a cable terminal which is capable of connecting two woven ribbon cables to a terminal connector and selectively interconnecting the two woven ribbon cables. The present invention utilizes a switch to selectively interconnect the two woven cables to provide the ability to "wrap the channel back" whenever the cable terminal is disconnected. This is typically needed for tag cables which must be disconnected from a controller box, or other peripheral device, and provides the ability to communicate information back to a central processor unit.

The present invention may, therefore, comprise a cable terminal having a terminal connector for providing a connection between the cable terminal and a standardized device connector, a first woven ribbon cable connected to the cable terminal, a second woven ribbon cable connected to the cable terminal, a switch for selectively interconnecting the first and second cables, a printed circuit board having connectors on two sides for providing two-sided termination of the first and second woven ribbon cables, the printed circuit board comprising, a cable connector for connecting the first and second woven ribbon cables to the printed circuit board, a switch connector for connecting the switch to the printed circuit board, and pad contact means for connecting the printed circuit board to the terminal connector, housing means for physically coupling the first and second woven ribbon cable, the printed circuit board and the terminal connectors to provide strain relief between the first and second woven ribbon cable and the printed circuit board and to hold the terminal connector in engagement with the pad contact device.

The present invention may also comprise a method for connecting a first woven ribbon cable and a second woven ribbon cable to a terminal connector and for selectively interconnecting the first and second woven ribbon cables comprising the steps of, connecting signal wires of the first woven ribbon cable to first signal connectors disposed on a first side of a printed circuit board, mass terminating ground wires of the first woven ribbon cable by crimping wires of the ground wires in a first ground clamp, connecting the first ground clamp to a ground connector disposed on the first side of the printed circuit board, connecting signal wires of the second woven ribbon cable to second signal connectors disposed on a second side of the printed circuit board, mass terminating ground wires of the second woven ribbon cable by crimping and soldering the ground wires in a second ground clamp, connecting the second ground clamp to a ground connector disposed on the second side of the printed circuit board, mounting a switch to switch connectors on the printed circuit board, conductively connecting the first and second signal connectors, the ground connectors, the switch connectors and pad connectors disposed on the printed circuit board such that the first and second signal connectors are conductively connected to predetermined pad connectors and operation of said switch produces selective interconnection of the first and second signal connectors, and, coupling the terminal connector to the printed circuit board to connect the first and second woven ribbon cables to the terminal connector.

The advantages of the present invention are that the printed circuit board provides two sides for connection of the two woven ribbon cables and separate connectors for each of the signal wires on each side of the printed circuit board. This allows for quick and easy termination of the ribbon cables in the cable terminals since each wire can be bent and inserted in a separate connector opening which is aligned directly with the position of the signal wire within the ribbon cable. Selective interconnection to the various pad connectors is provided by the circuitry on the printed circuit board. This eliminates confusion and problems of incorrect connection of the ribbon cable to the output connector pins of the terminal connector. Additionally, the signal wires can be bent at end portions and inserted, in a simple and easy manner, in the openings in the printed circuit board and, as such, are held in position during the soldering process. Since a separate opening is provided for each signal wire of each woven ribbon cable, two separate wires do not have to be connected to a single connector, and thereby eliminating considerable difficulties in the fabrication process. Also, the present invention allows the ground wires to be separated from the signal wires and clamped together in a mass terminating ground clamp which is dipped into a solder bath to form a mass ground terminator. Each of the mass ground terminators is inserted in separate connectors on the PC board to provide a quick and easy method of terminating the ribbon cables. The two-sided termination eliminates problems of intermixing of the cables and the resulting confusion caused thereby. Additionally, teeth or fingers are provided in the housing of the cable terminal which engage raised positions in the woven ribbon cables to provide strain relief to the cable terminal. Also, catch devices are provided in the side portions of the cable terminal for interacting with standardized latch and hook connectors provided on terminal connectors. Additionally, since strain relief is provided by an integral portion of the housing of the cable terminal, the cable terminal can be disassembled to allow repair of broken or misconnected conductive connections.

BRIEF DESCRIPTION OF THE DRAWINGS

An illustrative and presently preferred embodiment of the invention is shown in the accompanying drawings, wherein.

DETAILED DESCRIPTION OF THE INVENTION

Figures 1, 2, 3, 4, 5:
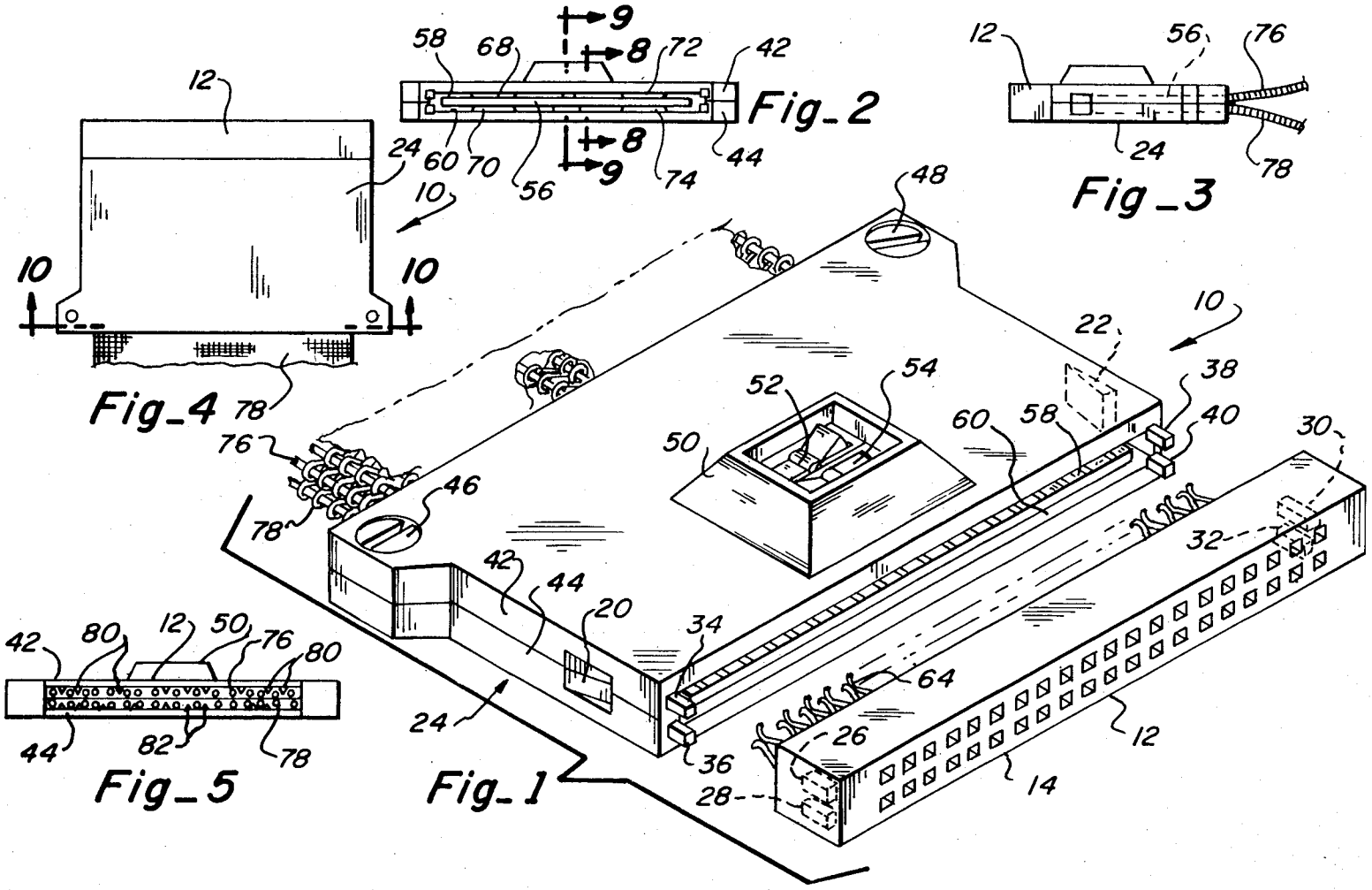
FIG. 1 is a perspective view of the cable terminal of the present invention.
FIG. 2 is a front-end view of the cable terminal of the present invention without the terminal connector.
FIG. 3 is a side view of the device illustrated in FIG. 1.
FIG. 4 is a top view of the device illustrated in FIG. 1.
FIG. 5 is a back-end view of the device illustrated in FIG. 1.

FIG. 1 schematically illustrates the cable terminal 10 of the present invention. Cable terminal 10 has a terminal connector 12 which is designed to conductively couple to a standardized device connector mounted on a device such as a CPU, controller unit, storage device, or other peripheral device. Terminal connector 12 can also connect to other standardized connectors used in the various electronic arts for various purposes. Terminal connector 12 can comprise either a female connector having a series of sockets 14, such as illustrated in FIG. 1, or a male connector having a plurality of pins. The type of terminal connector selected can vary with the intended use of the cable terminal. The characteristics of terminal connector 12 allow selection of a terminal connector 12 which fits the intended use of the cable terminal.

Terminal connector 12 is connected to printed circuit (PC) board 56 by way of slip connectors 64 which are soldered to pad connectors 62 to hold terminal connector 12 to main body portion 24. Catch means 20, 22 are formed in the main body portion 24 of cable terminal 10 to engage a lock and inject header (not shown) which comprises a hook (not shown) on a connector device (not shown) which engages cable terminal 10 to provide a releasable connection between the connector device (not shown) and cable terminal 10. Openings 26, 28, 30, 32 formed in terminal connector 12 engage posts 34, 36, 38, 40 in main body portion 24. Posts 34, 38 form a portion of the upper housing of main body portion 24. Similarly, posts 36, 40 form a portion of lower housing 44 of main body portion 24. Engagement of openings 26, 28, 30, 32 with posts 34, 36, 38, 40 function to hold upper housing 42 and lower housing 44 together along the front portion of the main body portion 24. Screw connectors 46, 48 hold upper housing 42 and lower housing 44 together along back portions of the main body portion 24.

Upper housing 42 has a raised structure 50 formed on its upper surface having an opening 52 in which a switch 54 is placed. Opening 52 has a knock-out portion formed therein such that opening 52 may be closed along the upper surface of upper housing 42 if switch 54 is not installed in the cable terminal 10. Upper housing 42 and lower housing 44 are formed by plastic mold injection techniques and utilize a nylon-reinforced plastic which has good rigidity over a wide range of temperatures and is fire retardant.

A printed circuit (PC) board 56, otherwise known as a "paddle board," is held in position between the upper housing 42 and lower housing 44 such that a gap 58 is formed between upper housing 42 and printed circuit board 56. Similarly, a gap 60 is formed between printed circuit board 56 and lower housing 44. Printed circuit board 56 has a series of pad connectors 62 on both upper and lower surfaces which are engaged by a series of slip connectors 64 on terminal connector 12. This establishes the conductive connection between the main body portion 24 and the terminal connector 12 of cable terminal 10.

FIG. 2 is a front-end view of main body portion 24 of the cable terminal 10 of the present invention. As illustrated in FIG. 2, gaps 58, 60 are provided between PC board 56 and the upper and lower housing 42, 44, respectively. PC board 56 is held in position by a center support shaft 66 which protrudes through an opening in the PC board to hold it stationary relative to upper housing 42 and lower housing 44. The shaft 66 is secured to lower housing portion 44 and fits into an opening in upper housing 42. Support pads 68, 70, 72, 74 are provided in a central portion of upper housing 42 and lower housing 44 to support PC board 56 in a centralized position approximately half-way between upper housing 42 and lower housing 44. The location of pad support, 68, 70, 72, 74 on centralized portions of the housing provide sufficient space for gaps 58, 60 to be maintained near the front end portion of main body portion 24 so that there is room for slide connector 64, of terminal connector 12, to be inserted and engage pad contact 62.

FIG. 3 is a schematic side view of the interconnection of terminal connector 12 in main body portion 24. FIG. 3 also illustrates an upper woven ribbon cable 76 and a lower woven ribbon cable 78 inserted in the back-end portion of main body portion 24. The replacement of the PC board 56 and support posts 66 are also schematically illustrated in FIG. 3.

FIG. 4 comprises a bottom view of the cable terminal 10 of the present invention. FIG. 4 illustrates the manner in which terminal connector 12 engages the main body portion 24.

FIG. 5 is a schematic end view illustrating the back-end of main body portion 24 and cables 76, 78 disposed within the cable terminal 10. As illustrated in FIG. 5, a plurality of teeth 80 are disposed on the back-end portion of upper housing 42. Similarly, a series of teeth 82 are disposed on the back end portion of lower housing 44. Upon assembly of the upper housing 42 to lower housing 44 by way of screw connectors 46, 48, teeth 80 engage the woven ribbon cable 76 to secure woven ribbon cable 76 to upper housing 42. Similarly, teeth 82 engage woven ribbon cable 78 to secure woven ribbon cable 78 to lower housing 44. The woven ribbon cables 76, 78 have raised portions which are engaged by teeth 80, 82 to provide strain relief between the woven ribbon cables 76, 78 and PC board 56. The raised portions of woven ribbon cables 76, 78 result from the weaving of the cables and are aligned transversely to the length of the cable. Consequently, engagement of teeth 80, 82 provides strain relief from outward forces applied on cables 76, 78 relative to main body portion 24.

Figure 6:
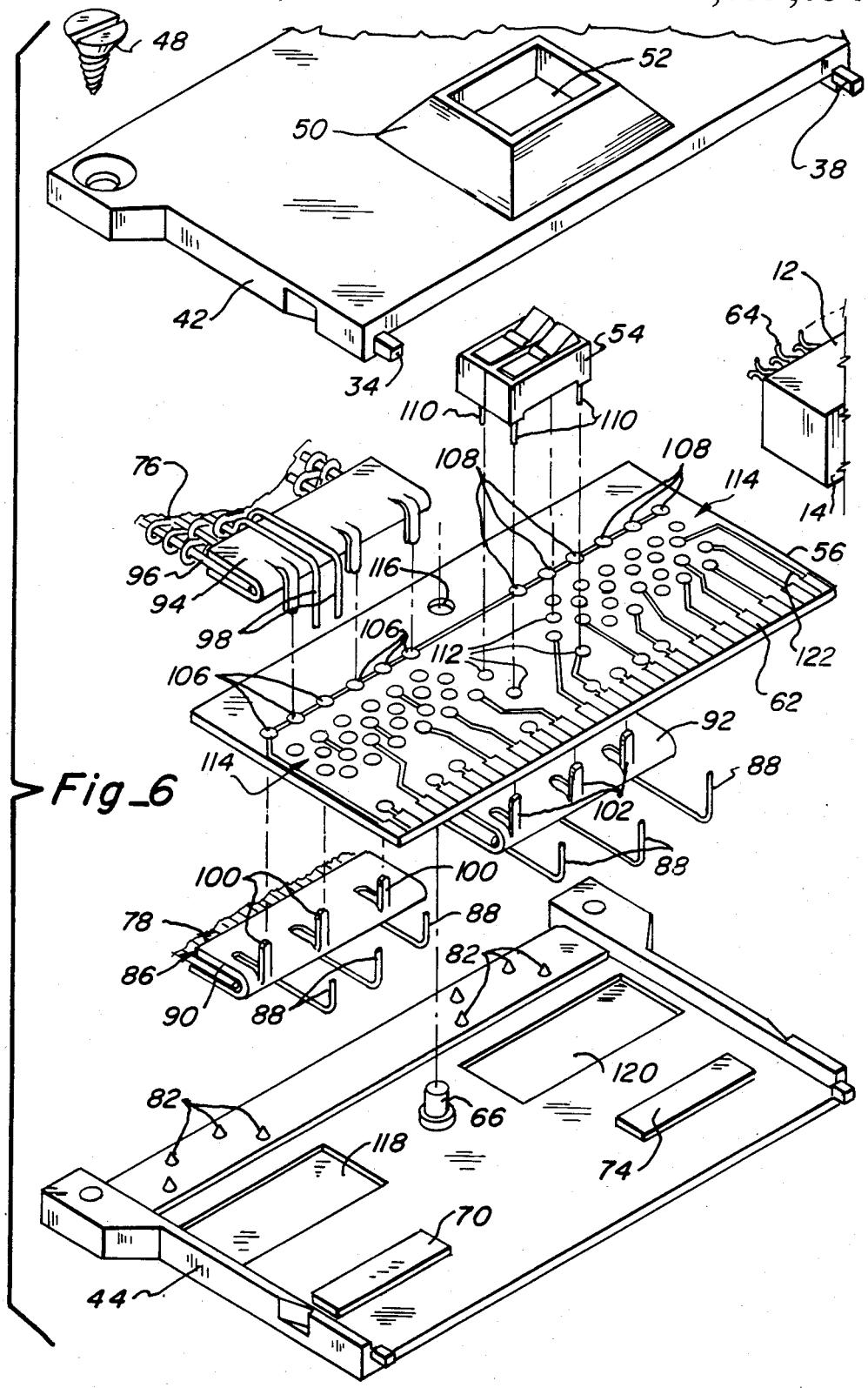
FIG. 6 is an exploded view of the device illustrated in FIG. 1.

FIG. 6 is an exploded view of the cable terminal 10 of the present invention. As illustrated in FIG. 6 upper housing 42 and lower housing 44 surround printed circuit board 56 having a series of connectors disposed thereon. Teeth 82 of lower housing 44 engage woven ribbon cable 78. As illustrated in FIG. 6, woven ribbon cable 78 contains a series of ground wires 86 which are separated from signal wires 88 and connected to mass ground terminators 90, 92. Similarly, mass ground terminator 94 connects ground wires 96 of woven ribbon cable 76 after separation from signal wires 98. Mass ground terminator 90 has a series of teeth 100 which engage ground connectors on PC board 56. Similarly, mass ground terminator 92 has a series of teeth 102 which engage and are conductively connected to ground connections on the lower portion of PC board 56. Teeth 104 of mass ground terminator 94 engage ground connectors 106 on PC board 56. A second ground terminator (not shown), connected to woven ribbon cable 76, is connected to ground connectors 108 of PC board 56. Switch 54 has a plurality of connector posts 110 which engage switch connectors 112 on PC board 56. Connector post 110 functions to provide a conductive connection of switch 54 to switch connectors 112 by soldering, and also provides a physical support for switch 54 which rests on the upper surface of PC board 56. Opening 52 in raised structure 50 allows switch 54 to be accessed through upper housing 42 upon removal of a knock-out portion, as disclosed above. Raised structure 50 does not provide a physical mount for switch 54, but rather, provides protection for switch 54.

Signal wires 98 are bent at ends portions and inserted in signal connectors 114 on printed circuit board 56. The bent ends of signal wires 98 allow easy insertion in the openings of connectors 114. A separate connector opening 114 is provided for each signal wire 98. Both signal wires 98 and ground wires 96 are covered with a varnish material which is removed upon application of heat and solder. The solder functions to conductively connect and physically hold these wires to signal connectors 114 and mass ground terminator 94. Of course, the same is true for signal wires 88 and ground wires 78.

Support pads 70, 74 on lower housing 44 are also illustrated in FIG. 6. Additionally, support post 66 is attached to lower housing 44 which engages opening 116 and printed circuit board 156 to hold printed circuit board 56 in a stationary relationship with regard to main body portion 24. Recess portions 118, 120 provide sufficient room for mass ground terminators 90, 92, respectively, upon assembly of upper housing portion 42 to lower housing 44. Similar recess portions are also provided in upper housing portion 44 to provide sufficient room for mass ground terminator 94 and an additional mass ground terminator (not shown). Printed circuit board 56 has a plurality of conductive connectors 122 which interconnect the signal and ground connectors to pad connectors 62.

Figure 7:
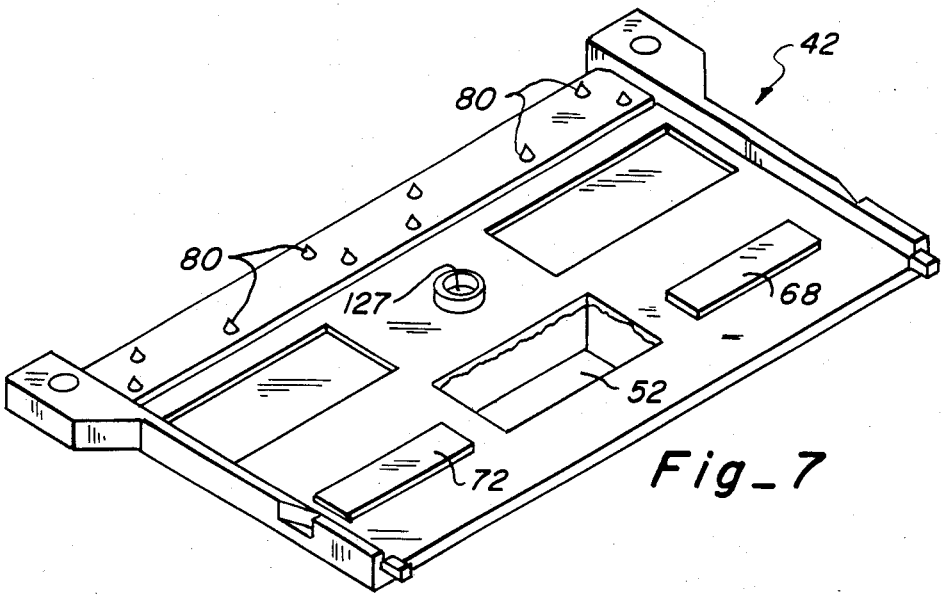
FIG. 7 is an inside view of the top portion of the housing of the cable terminal.

FIG. 7 is a perspective view of the inside of upper housing 42. Upper housing 42 has recess portions 124, 126 to allow sufficient room for a mass ground terminators of ground wires 96 in woven ribbon cable 76. Opening 127 is also provided in upper housing 42 for engagement with post 66 of lower housing portion 44. Support pads 68, 72 for PC board 56 are also illustrated in FIG. 7. These support pads engage the PC board at positions between signal connectors 114 and pad connectors 62 where no conductive connections are made. Teeth 80, which engage woven ribbon cable 76, are also illustrated in FIG. 7. Opening 52 is provided by removal of a knock-out portion from edge 128.

Figure 8:
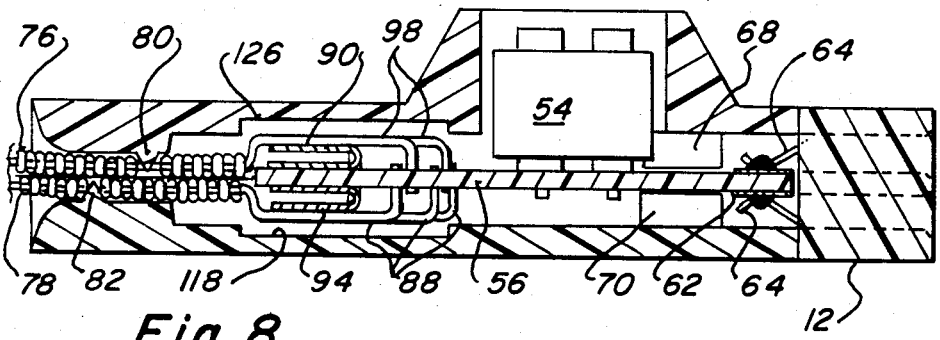
FIG. 8 is a sectional view of the device of FIG. 1.

FIG. 8 is a sectional view of the main body portion as illustrated in FIG. 2. FIG. 8 discloses the manner in which teeth 80, 82 engage woven ribbon cable 76, 78. Round clamps 90, 94 as well as signal wire 98, 88 are shown conductively connected to printed circuit board 56. Recess portions 118, 126 provide sufficient room for signal wires 88, 98 and ground terminators 90, 94. FIG. 8 also illustrates the manner in which switch 54 conductively connected and physically supported by printed circuit board 56. Support pads 68, 70 also illustrate the manner in which they support printed circuit board 56. Slip connector 64 of terminal connector 12 are shown conductively connected to pad connectors 62 of printed circuit board 56.

Figure 9:
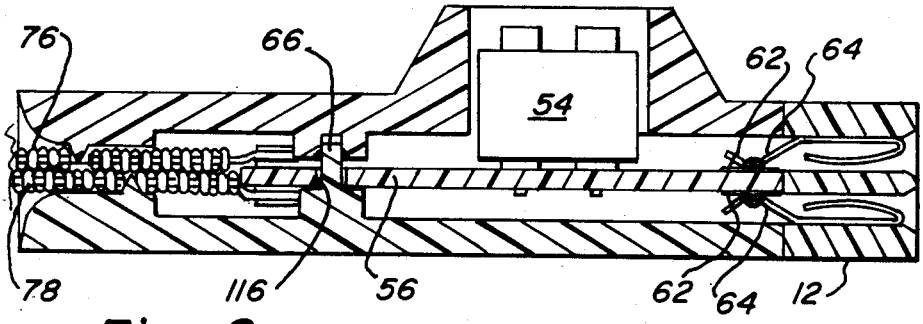
FIG. 9 is a sectional view of the device of FIG. 1.

FIG. 9 is a cross-sectional view of the main body portion of the cable terminal 10 of the present invention as illustrated in FIG. 2. FIG. 9 illustrates the manner in which post 66 engages opening 116 in printed circuit board 56 to support printed circuit board 56 in a centered position within the main body portion 24.

Figure 10:
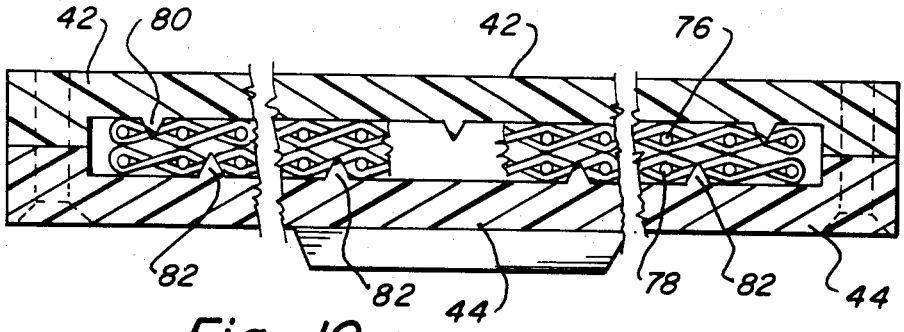
FIG. 10 is a sectional view of the device of FIG. 5.

FIG. 10 schematically illustrates the manner in which teeth 80 of upper housing 42 engage woven ribbon cable 76, and teeth 82 of lower housing 44 engage woven ribbon cable 78. As disclosed above, teeth 80, 82 penetrate between the individual wires of the woven ribbon cables and engage transverse raised portions of the woven ribbon cable to prevent movement in a longitudinal direction (in or out) relative to the main body portion 24. This provides a solid connection between the housing members 42, 44 and the woven ribbon cables 76, 78 without causing any destruction of the woven ribbon cables.

Figure 11:
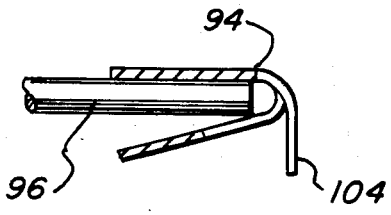
FIGS. 11 and 12 illustrate the operation of the mass ground terminator.
Figure 12:
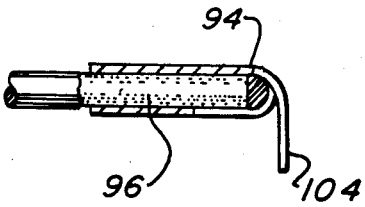

FIGS. 11 and 12 schematically illustrate the manner in which the mass ground terminator provides a connection to the ground wires of the woven ribbon cables. The mass ground terminator, such as mass ground terminator 94, is formed in a C-clamp, as illustrated in FIG. 11, to engage the ground wires. Prongs 104 are pressed from portions of the C-clamp. A plurality of ground wire, such as ground wires 96, are separated from woven ribbon cable 76 and positioned in the clamp portion of mass ground terminator 94. As illustrated in FIG. 12 the clamp portion of mass ground terminator 94 is then deformed to engage ground wires 96 to physically hold the ground wires 96 within the mass ground terminator 94. To provide a secure physical and conductive connection, the clamp portion is then dipped into a solder bath which conductively and physically connects the ground wires 96 to mass ground terminator 94.

Figure 13:
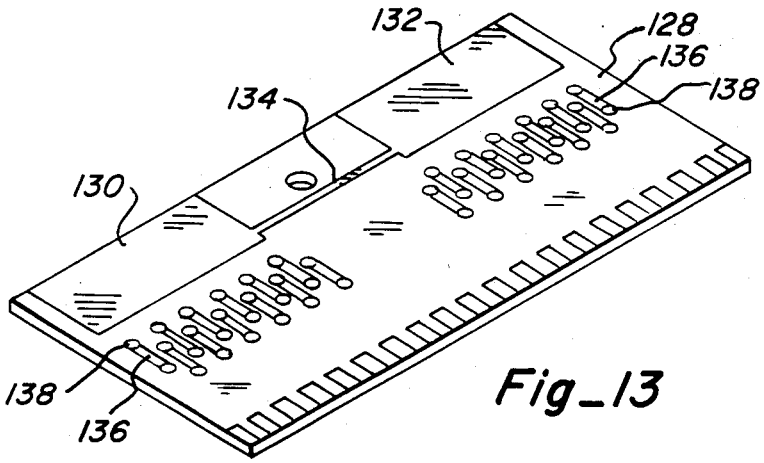
FIG. 13 is a schematic isometric view of an alternative embodiment of a printed circuit board of the present invention.

FIG. 13 discloses an alternative manner of forming the printed circuit board 56 illustrated in FIG. 1. The printed circuit board 128 of FIG. 13 utilizes ground pads 130, 132 which are conductively connected by connector 134. Additionally, pads 136 are disposed in the interstitial portions between adjacent connector openings. Pad connectors 130, 132 allow presoldered ground wires to be placed adjacent ground pads 130, 132 and solder pressed to make a conductive connection by simply supplying heat and pressure to the ground wires. Similarly, pads 136 allow the signal wires to be connected in the same manner by applying a coat of solder to the signal wires in a solder bath and positioning the signal wires over pad connectors 136 so that heat and pressure cam be applied to the signal wires to conductively connect them to pad connectors 136. Connector openings 138 can remain in the printed circuit board to provide an alternative manner of connecting the signal wires. The printed circuit board embodiment of FIG. 13 allows certain automated procedures for connecting both signal wires and ground wires to printed circuit board 128.

The present invention, therefore, provides a cable terminal which is capable of connecting two woven ribbon cables in a simple and easy manner to a terminal connector which is designed to interact with standard device connectors. Switch means are provided for selectively interconnecting the cables to allow the channel to be "wrapped back," in computer applications, when the cable terminal is disconnected from a peripheral device. The cable terminal can be easily disassembled to allow repair and reduce the trash rate during fabrication. Additionally, the main body portion of the cable terminal interacts with the terminal connector to provide a mechanical and electrical connection which allows the terminal connector to be easily interchanged. Separate signal connectors are provided on the printed circuit board for each signal wire of the woven ribbon cables to aid in ease of connection. Mass ground terminators are also provided to simplify connection of ground wires to the cable terminal. Teeth means formed into the housing portion of the main body of the terminal connector physically secure the two woven ribbon cables to the main body portion to provide strain relief. Two sided connection on a printed circuit board aids in simplification of the connections of the two woven ribbon cables in the cable terminal. Conductive connectors allow in-line connection of the signal wires on the printed circuit board to eliminate confusion and possible mistakes which result from the crossing of wires within the cable terminal.

The foregoing description of the invention has been presented for purposes of illustration and description. The foregoing description is not intended to be exhaustive or to limit the invention to the precise form disclosed, and other modifications and variations may be possible in light of the above teachings. The embodiment was chosen and described in order to best describe the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A cable terminal capable of connecting a first woven ribbon cable and a second woven ribbon cable to a standardized terminal connector and selectively interconnecting said first and second woven ribbon cables comprising:

switch means for selectively interconnecting said first and second woven ribbon cables;

first mass ground terminator means for conductively connecting ground wires of said first woven ribbon cable by simultaneously physically securing and electrically connecting said ground wires to said first mass ground terminator means;

second mass ground terminator means for conductively connecting ground wires of said second woven ribbon cable by simultaneously physically securing and electrically connecting said ground wires to said first mass ground terminator means;

printed circuit board means comprising:

first signal connector means for connecting signal wires of said first woven ribbon cable means to a first side of said printed circuit board means, said first signal connector means having connector opening means for connecting each of said signal wires of said first woven ribbon cable to separate openings on said first side of said printed circuit board means and each of said signal wires of said second woven ribbon cable to separate openings on a second side of said printed circuit board means such that said signal wires are physically secured and electrically connected to said printed circuit board means to allow rapid connection and repair of said cable terminal;

second signal connector means for connecting signal wires of said second ribbon cable means to said second side of said printed circuit board means, said second connector means having connector opening means for connecting each of said signal wires of said first woven ribbon cable to separate openings on said first side of said printed circuit board means and each of said signal wires of said second woven ribbon cable to separate openings on said second side of said printed circuit board means such that said signal wires are physically secured and electrically connected to said printed circuit board means to allow rapid connection and repair of said cable terminal;

first ground connector means for connecting said first mass ground terminator means to said first side of said printed circuit board means;

second ground connector means for connecting said second mass ground terminator means to said second side of said printed circuit board means;

switch connector means for connecting said switch means to said printed circuit board means;

pad contact means for providing a conductive connection between said printed circuit board means and said standardized terminal connector;

printed circuit board conductor means conductively connected to said first and second signal connector means, said first and second ground connector means, said switch connector means and said pad contact means such that said signal wires and ground wires of said first and second woven ribbon cables are connected to predetermined pad elements of said pad contact means and said switch means is capable of selectively interconnecting said signal wires of said first and second woven ribbon cables;

housing means for providing a cover for said cable terminal comprising:

releasable connector means for joining portions of said housing means to allow said housing means to be disassembled for repair of said cable terminal;

catch means disposed on said housing means;

mounting means for mounting said switch means;

teeth means disposed to engage said first and second woven ribbon cables along transverse raised portions of said first and second woven ribbon cables resulting from weaving of said cables to provide strain relief between said printed circuit board means and said first and second woven ribbon cables; and, support means for securing said printed circuit board means to said housing means.

2. The cable terminal of claim 1 wherein said first and second mass ground terminator comprises:

rounded clamp means for simultaneously physically securing and electrically connecting said ground wires by crimping said clamp means onto said ground wires and soldering said ground wires in said clamp means.

3. A method for connecting a first woven ribbon cable and a second woven ribbon cable to a terminal connector and for selectively interconnecting said first and second woven ribbon cables comprising the steps of:

connecting signal wires of said first woven ribbon cable to first signal connectors disposed on a first side of a printed circuit board;

mass terminating ground wires of said first woven ribbon cable by crimping and soldering said ground wires in a first ground clamp;

connecting said first ground clamp to a ground connector disposed on said first side of said printed circuit board;

connecting signal wires of said second woven ribbon cable to second signal connectors disposed on a second side of said printed circuit board;

mass terminating ground wires of said second woven ribbon cable by crimping and soldering said ground wires in a second ground clamp;

connecting said second ground clamp to a ground connector disposed on said second side of said printed circuit board;

connecting a switch to switch connectors on said printed circuit board;

conductively connecting said first and second signal connectors, said ground connectors, said switch connectors and pad connectors disposed on said printed circuit board such that said first and second signal connectors are conductively connected to predetermined pad connectors and operation of said switch produces selective interconnection of said first and second signal connectors;

coupling said terminal connector to said printed circuit board to connect said first and second woven ribbon cables to said terminal connector;

coupling said printed circuit board to a housing by inserting a post on said housing through an opening in said printed circuit board;

interconnecting teeth disposed om said housing with lateral raised portions of said first and second woven ribbon cables produced by the weaving of the cables to provide strain relief between said first and second woven ribbon cables and said printed circuit board;

connecting portions of said housing together in a manner which allows disassembly of said housing and repair of conductive connections to said printed circuit board;

inserting posts on said housing into said terminal connector to secure said standardized terminal connector to said housing; and, conductively coupling said terminal connector to said pad connectors disposed on said printed circuit board by sliding conductors on said terminal connector onto said pad connectors.

* * * * *